United States Patent [19]

Ramsey

[11] 4,372,546

[45] Feb. 8, 1983

[54] SPRING ASSEMBLY

[75] Inventor: Henry R. Ramsey, Dudley, Mass.

[73] Assignee: Webster Spring Co. Inc., Oxford, Mass.

[21] Appl. No.: 247,347

[22] Filed: Mar. 23, 1981

[51] Int. Cl.[3] ..... F16F 3/02; A47C 23/053

[52] U.S. Cl. ..... 267/100; 5/266

[58] Field of Search ..... 5/248, 252, 256, 266; 267/91, 95, 99, 100, 101

[56] References Cited

U.S. PATENT DOCUMENTS 3,662,411 5/1972 Garleau ..... 267/100 X 4,004,304 1/1977 Kane ..... 5/256 X

FOREIGN PATENT DOCUMENTS 1231848 4/1960 France ..... 267/101

*Primary Examiner*—Duane A. Reger

*Attorney, Agent, or Firm*—Robert T. Gammons

[57] ABSTRACT

A spring assembly of the kind comprising a rigid base frame, a wire grid frame, a plurality of helically-coiled springs attached at one end to the base frame and at their other ends to the wire of the grid frame, said wires and ends of the coils being so structured as to enable detachably attaching the ends of the coils to the wires of the grid frame in overlapping locking engagement with the wires of the grid frame without the aid of wire clips or the like.

14 Claims, 13 Drawing Figures

SPRING ASSEMBLY

BACKGROUND OF INVENTION

In U.S. Pat. Nos. 3,662,411 and 3,684,270, the entire right, title and interest to which has been assigned to the assignee of the present application, there are shown spring assemblies wherein helical coil springs are detachably attached to the wires of a grid frame. In these patents, the grid frame has transversely and longitudinally right-angularly disposed wires which define substantially rectangular seats for the ends of the coils to be attached thereto and the end loops of the coils are provided with segmental portions which extend from the spaces within which the coils are positioned into the next adjacent space beneath the wire defining the spaces and deviations which extend back into the spaces above the wire. The coils can be attached by expanding the end coils to cause the deviations to clear the wires and then allowing the ends to contract to their normal configuration. Alternately, the wires of the grid frame may be displaced toward each other to clear the extremities of the deviations and then allowed to return to their normal spacing. In the aforesaid structures in any given transverse row, the coils are spaced apart the distance of a single space and the transverse rows of coils are spaced longitudinally a distance more or less than a single space. It is desirable sometimes to reinforce, that is, stiffen the assembly in certain areas, notably at the longitudinal edges or in certain localized areas such as the normal positions of shoulders or hips. One way of accomplishing this has been to add coils. However, since the addition of the coils must normally be incorporated at the time of manufacture, specially reinforced spring assemblies must be custom-made. It is one of the purposes of this invention to so construct the assembly of the supporting frame and the grid that the springs can be added to or removed from an already constructed assembly to change the stiffness of the assembly at the edges or within certain interior areas at will without the necessity of using special machinery or tools to thereby avoid the cost of custom manufacture. The base frame of most assemblies is usually a rectangular wooden frame comprising longitudinally-spaced, transversely-extending cross bars to which the lower ends of the spring are attached. As previously explained, the conventional arrangement is to space the coils transversely the distance of a coil apart and to space the transverse rows of coils longitudinally the distance of a coil apart. With such an arrangement, in order to strengthen the assembly, it is necessary to add cross bars for supporting coils between two rows of coils which is objectionable because it adds substantially to the weight of the assembly. It is the purpose of this invention not only to provide for detachably attaching the coils to the grid, but to enable positioning the coils in the spaces between coils in a row without adding cross supports to the base frame and only minor structural changes in the grid.

SUMMARY OF THE INVENTION

As herein illustrated, the spring assembly comprises a base frame, a grid frame embodying transverse and longitudinally-extending, right-angularly crossing wires attached to a border wire, said crossing wires defining longitudinally and transversely-aligned openings and a plurality of helically-coiled springs attached at one end to the base frame and at their other ends to the grid wires in rows transversely of the grid within the spaces defined by the crossing wires characterized in that the ends of the springs attached to the wires comprise loops of larger diameter than the distance between the wires defining the spaces within which the coils are positioned so that segmental portions of adjacent loops extend from the openings within which the coils are positioned beyond the wires defining said openings into adjacent openings and wherein the segmental portions at one diametral side of the adjacent loops contain deviations which extend back into the spaces from which the loops extend into overlapping relation with the segmental portions of the adjacent coils. In the preferred form, there are deviations in both the segmental portions, that is, diametrically opposite each other extending inwardly toward the centers of the coils. The segmental portions of the adjacent loops cross under the wires and the deviating portions cross over the wires in overlapping relation. The wires contain deviating portions in a plane perpendicular to the plane of the grid extending above and below the plane of the grid and the segmental portions of the loop extend through the upwardly displaced deviations and the deviation in the loops extend through the downwardly-displaced deviations.

The invention will now be described in greater detail with reference to the accompanying drawings, wherein.

Figure 8:
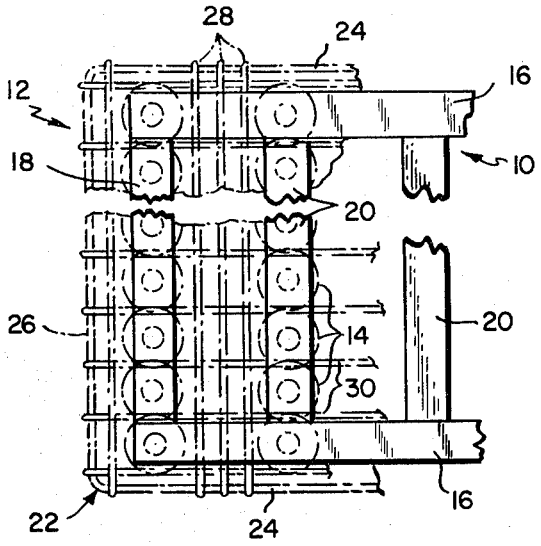
FIG. 8 is a fragmentary plan view of a spring assembly showing the base frame and the grid frame.
Figure 9:
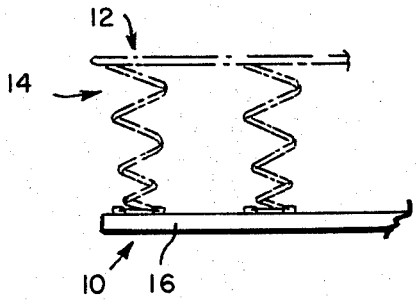
FIG. 9 is a fragmentary elevation taken on the line 9—9 of FIG. 8.

Referring to the drawings, FIGS. 8 and 9, the spring assembly is of generally rectangular configuration, narrower in width than in length and comprises a base frame 10 and grid frame 12 and a plurality of helically-coiled springs 14 positioned between the base frame 10 and the grid frame 12 and fastened at its ends, respectively, to the base frame and grid frame.

The base frame 10 is generally comprised of wood and is made up of spaced, parallel side members 16—16;

spaced, parallel end members 18—18 positioned at right angles to the side members 16—16 and at the opposite ends thereof; and longitudinally-spaced, transversely-extending bars 20 fixed at their opposite ends to the side members 16—16.

Figure 2:
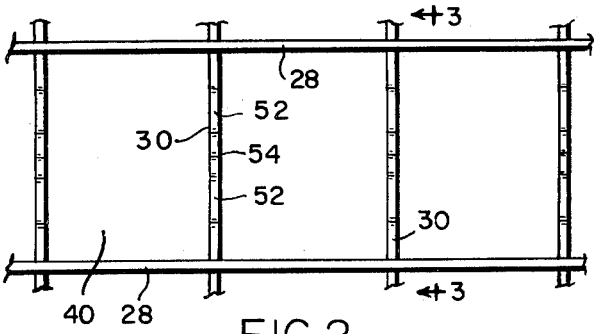
FIG. 2 is a plan view of a portion of the grid at the top of the frame to which the upper ends of the helically-coiled springs are attached to somewhat smaller scale.
Figure 3:
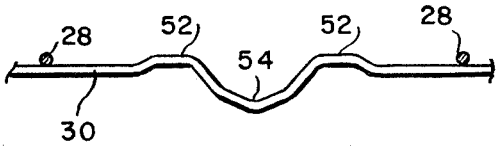
FIG. 3 is an elevation to larger scale taken on the line 3—3 of FIG. 2.
Figure 4:
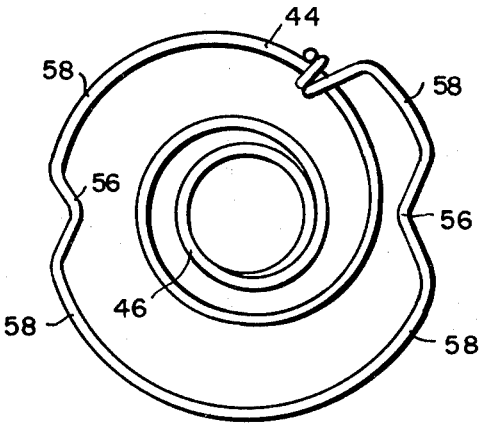
FIG. 4 is a plan view of the upper end of a helically-coiled spring.
Figures 5, 6, 7:
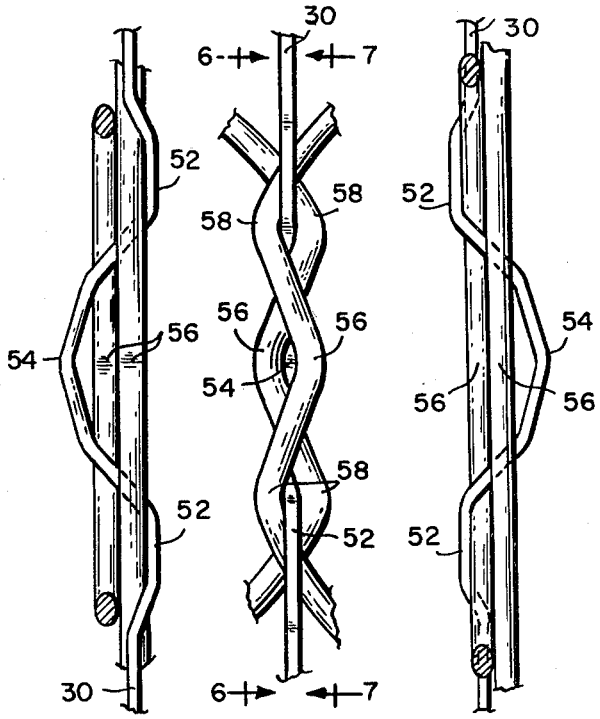
FIG. 5 is an enlarged fragmentary plan view of the overlapping interengagement of adjacent coils with the wires to which the coils are attached.
FIG. 6 is an elevation taken on the line 6—6 of FIG. 5.
FIG. 7 is an elevation taken on the line 7—7 of FIG. 5.

The grid frame 12, FIGS. 2 and 8, comprises a border wire 22 having spaced, parallel sides 24—24; spaced, parallel ends 26—26 at right angles to the sides 24—24; spaced, parallel, transversely-extending grid wires 28 and spaced, parallel, longitudinally-extending wires 30 crossing the wires 28 at right angles. The crossing wires are welded at their crossing and define spaces 40 within which the coiled springs are positioned transversely of the base and grid frame in all of the openings and longitudinally thereof in alternate openings.

The coils 14 are desirably of helical configuration and taper from top to bottom, the upper ends comprising loops 44 of relatively large diameter and the lower ends comprising loops 46 of smaller diameter. The lower ends of the coils are attached to the bars 18 and 20 by means of fastening elements such as staples.

For the purpose of detachably fastening the coils to the grid wires in such a way as to enable adding to and removing coils in a single transverse row and so as to enable positioning the coils in strategic positions, for example, along the border or in areas within the border, the wires of the grid frame, specifically the longitudinally-extending wires 30, are provided with deviations 52—52 and 54 and the loops 44 at the upper ends of the coils have diametrically-positioned deviations 56—56.

The deviations 52—52 are displaced above the plane of the grid and the deviation 54 is displaced below the plane of the wire 50. The deviations in adjacent wires 30 are in alignment. The deviations 56—56 in the loop are in the plane of the loop.

The deviations 52—52 and 54 in the grid wires and the deviations 56—56 in the upper ends of the coils in combination function to detachably attach the coils at the upper ends to the wires so that in the transverse rows, the coils may be positioned in successive openings defined by the crossing wires in such a way as to become interlocked with each other and with the wires and thus positively prevent any lateral displacement of the grid wires themselves, in contrast to prior structure wherein, because of the absence of coils in the alternate spaces, there is a pronounced tendency for the wires to stretch laterally when pressure is applied perpendicularly to the upper surface.

Figure 1:
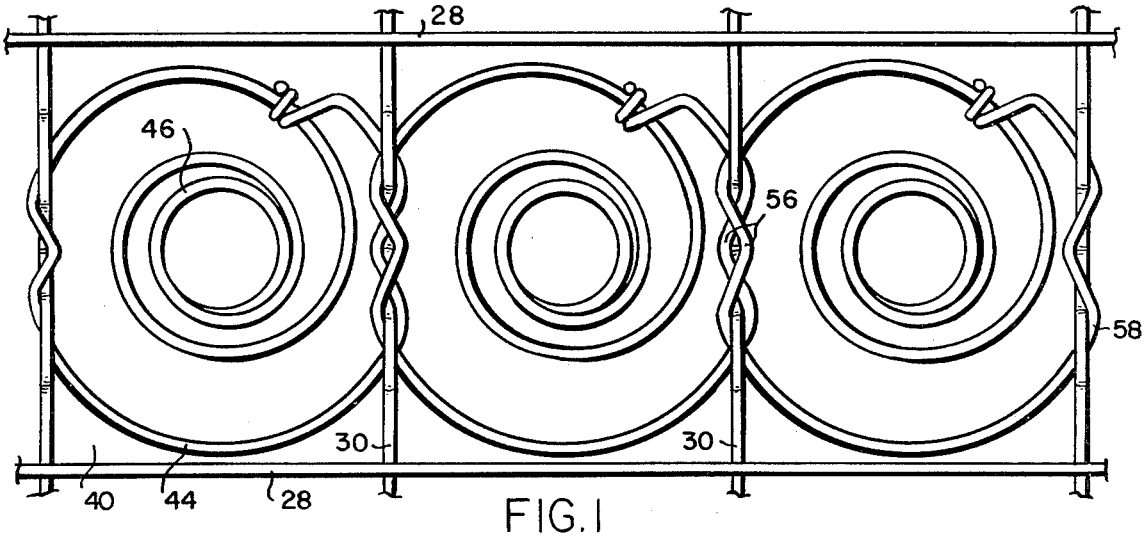
FIG. 1 is a plan view of a portion of the top side of a spring assembly showing transversely and longitudinally-spaced crossing wires and helically-coiled springs positioned in the rectangular spaces defined by the said crossing wires.

As herein illustrated, the top loops 44 of the coils are of larger diameter than the distance between the wires 30—30 and the coils are positioned in the spaces 40 defined by the orthogonally crossing wires as shown, for example, in FIG. 1. Hence, when the coils are positioned in adjacent openings 40, the segmental portions 58—58 at the diametrally-opposite sides of the loops at opposite sides of the deviations 56—56 extend from the openings 40 within which the respective coils are positioned, across the wires 30 into the adjacent openings in overlapping relation to each other and the deviating portions 56—56 within which the segmental portions recross the wires 30—30 in overlapping relation. To provide for such crossing and recrossing, the wires 30—30 contain downwardly-displaced and upwardly-displaced deviations 54 and 52—52. The segmental portions 58—58 of the loops pass through the upwardly-displaced deviations 52—52 beneath the wires 30—30 and the deviations 56—56 pass through the downwardly-displaced deviations 54—54 beneath the wires 30—30. In order to assemble the coils, a coil is placed at the underside of the grid frame with the segmental portions 58—58 at diametrically-opposite sides of the top loop within the upwardly-displaced deviating portions 52—52 of the wires 30—30 at each side, the top loop is expanded sufficiently to enable the apices of the deviations 56—56 to clear the wires 30—30 and then allowed to contract so as to draw the deviations 56—56 into the downwardly-displaced deviations 54—54 of the wires 30—30. The next coil in succession transversely of the grid frame as shown in FIG. 1 is similarly placed in a position in the space between the wires defining the space and below the wires so that the segmental portions at diametrically-opposite sides extend from the space beneath the wires into the adjacent spaces at each side above the segmental portions of the previously positioned coils with the segmental portions situated in the upwardly-deviating portions of the wires and the deviating portions extending back into the opening within which the coil is positioned in overlapping relation with the deviating portion of the adjacent coil. Thus, the adjacent sides of the coils are locked in overlapping relation to each other and to the wires. The remaining coils in the row are attached in the same fashion. The deviating portions 56—56 at opposite sides of the loops constitute, in effect, hooks operating in opposite directions to prevent lateral displacement of the wires 30—30 relative to each other.

It is to be observed that for such construction, the top loops of the coils must be of greater diameter than the distance between the wires so that the segmental portions of the loops extend from the opening within which the loops are positioned into the adjacent opening at each side and so that the deviating portions of the segmental portions can extend back from the adjacent openings into the opening within which the coil is positioned. It is also necessary that the deviations 54—54 be approximately as deep as twice the diameter of the wire of the coils.

Figure 10:
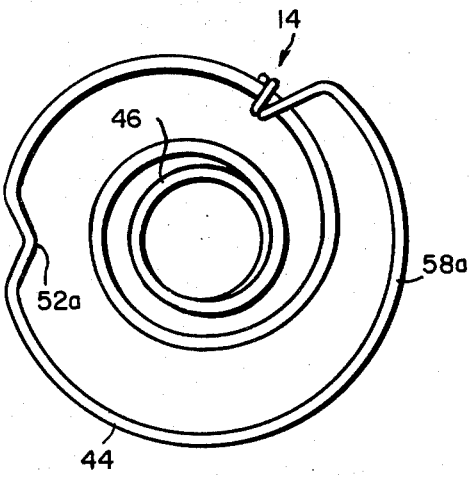
FIG. 10 is a plan view of a modified spring coil.
Figures 11, 12:
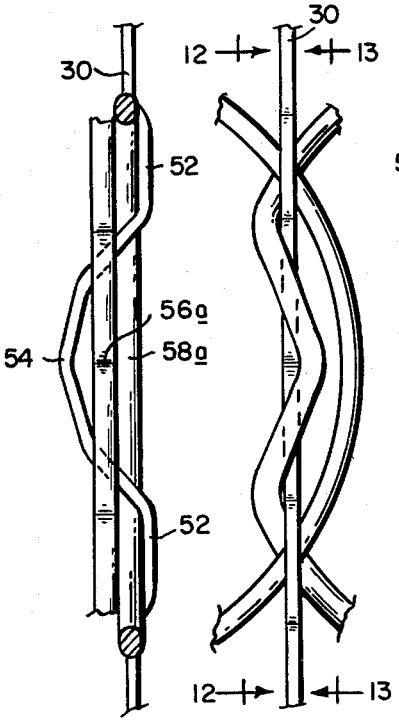
FIG. 11 is a fragmentary plan view of the overlapping interengagement of adjacent coils when using the modified coil of FIG. 10.
FIG. 12 is an elevation taken on the line 12—12 of FIG. 11.
Figure 13:
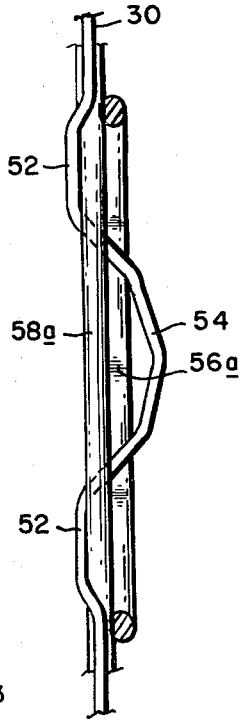
FIG. 13 is an elevation taken on the line 13—13 of FIG. 11.

The structure just described is the preferred structure. However, optionally, the top loop of the coil may contain only a single deviation **56*a* as shown in FIG. 10. When so constructed, a segmental portion 58*a* of the coil at one side becomes locked in place by the deviating portion 56*a* at the adjacent side of the adjacent coil. The segmental portion 58*a* overlies the deviating portion 56*a* as shown in FIGS. 11, 12 and 13 where the segmental portion is shown at 58*a* of one coil and the deviating portion 56*a*** of the adjacent coil.

As thus described, the spring assembly provided by the structure herein illustrated enables inexpensively tailoring spring assemblies to the particular specification of a customer without special machinery or tools.

The invention as herein illustrated has the further advantage that the number of springs per frame area may be increased without modifying the base frame by the addition of cross bars which would increase the weight of the assembly inordinately. Thus, it would be possible, by adding coils to specific regions and/or areas, to greatly strengthen the resistance of the assembly to displacement perpendicular to its surface as, for example, along the opposite edges or within the area at such areas as the hips and shoulders without altering the basic structure of the base frame. Still further, it is possible, by the addition of the spring, to obtain the same resistance to vertical displacement with a softer action by use of a large number of coils made of light gauge wire than is afforded by a fewer number of coils made of heavy gauge wire. This can be achieved not only to obtain a more comfortable spring assembly, but also with a saving in manufacturing cost and a saving in wire cost.

It should be understood that the present disclosure is for the purpose of illustration only and includes all modifications or improvements which fall within the scope of the appended claims.

What is claimed is:

1. A spring assembly comprising a base frame, a grid frame comprising a border wire of rectangular configuration and transversely and longitudinally-extending, right-angularly crossing grid wires attached at their ends to the border wire, said crossing grid wires defining longitudinally and transversely-aligned openings and a plurality of helically-coiled springs attached at one end to the base frame and at their other ends to the grid wires in rows transversely of the grid frame within the openings defined by the crossing grid wires characterized in that the ends of the coiled springs attached to the grid wires comprise loops of larger diameter than the distance between the wires defining the openings within which the coils are positioned so that segmental portions of the end loops cross the grid wires in overlapping relation into the adjacent openings and wherein there is a deviation in one at least of the segmental portions of each coil which recrosses the grid wires in the opposite direction.

2. A spring assembly according to claim 1 wherein the segmental portions of the adjacent loops extend from their respective openings into the adjacent openings beneath the wires between openings and the deviations in said segmental portions extend back into the openings from which the segmental portions extend over the wires between openings in overlapping relation.

3. A spring assembly according to claim 1 wherein the grid wires contain deviations through which the segmental portions of the loops and the deviations therein extend.

4. A spring assembly according to claim 1 wherein the grid wires contain deviations displaced upwardly through which the segmental portions extend.

5. A spring assembly according to claim 4 wherein the upwardly-displaced deviations in the grid wires are in planes parallel to the axis of the coil.

6. A spring assembly according to claim 1 wherein the grid wires contain deviations displaced downwardly through which the deviations in the segmental portions extend.

7. A spring assembly according to claim 6 wherein the downwardly-displaced deviations are in a plane parallel to the axis of the coils.

8. A spring assembly comprising a base frame, a grid frame comprising a rectangular border wire and transversely and longitudinally-extending, right-angularly crossing grid wires attached at their ends to the border wire, said crossing grid wires defining longitudinally and transversely-aligned openings and a plurality of helically coiled springs attached at one end to the base frame and at the other end to the grid wires in rows transversely of the grid frame within the openings defined by the crossing grid wires characterized in that the ends of the springs attached to the grid wires comprise loops of larger diameter than the distance between the grid wires defining the open spaces within which the coils are positioned so that segmental portions of the loops cross the grid wires in overlapping relation into the adjacent openings and wherein the segmental portions at one side of each coil contains a reversely bent deviation.

9. A spring assembly comprising a base frame, a grid frame comprising a border wire and transversely and longitudinally-extending, right-angularly crossing grid wires attached to a border wire, said crossing grid wires defining longitudinally and transversely-aligned openings and a plurality of helically-coiled springs attached at one end to the base frame and at their other ends to the grid wires in rows transversely of the grid frame within the openings defined by the crossing grid wires characterized in that the ends of the springs attached to the grid wires comprise loops of larger diameter than the distance between the grid wires defining the openings within which the coils are positioned so that segmental portions of the loops extend from the openings within which the coils are positioned beneath and beyond the grid wires defining said openings into said adjacent openings and said segmental portions containing deviations which extend back above the grid wires defining said openings into the openings within which the coils are positioned in overlapping relation to each other.

10. A spring assembly according to claim 5 wherein the wires contain deviating portions in a plane perpendicular to the plane of the grid frame extending above and below the plane of the grid frame and said segmental portions of the loops extend through the upwardly-displaced deviations in the wires and the deviations in the segmental portions extend through the deviations extending below the plane of the grid.

11. A spring assembly according to claim 8 wherein the deviations extending below the plane of the grid frame are of greater depth than the deviations extending above the plane of the grid frame.

12. A spring assembly according to claim 8 wherein the right-angularly crossing grid wires are welded at their crossings.

13. A spring assembly according to claim 9 wherein the segmental portions of adjacent coils overlap at the underside of the grid wires and the deviating portions overlap at the upper side of the grid wires.

14. A spring assembly according to claim 13 wherein the deviations cross the grid wires in opposite directions and resist displacement of the grid wires relative to each other.

* * * * *